US005361953A

United States Patent [19]

Nichols

[11] Patent Number: 5,361,953

[45] Date of Patent: Nov. 8, 1994

[54] SHOULDER HARNESS WITH CONNECTOR PIECE

[75] Inventor: Richard E. E. Nichols, San Diego, Calif.

[73] Assignee: Shooting Systems Group, Inc., Fenton, Mo.

[21] Appl. No.: 866,433

[22] Filed: Apr. 10, 1992

Related U.S. Application Data

[63] Continuation-in-part of Ser. No. 639,792, Jan. 10, 1991.

[51] Int. Cl.[5] ..... F41C 33/02

[52] U.S. Cl. ..... 224/198; 224/192; 224/206; 224/209; 224/911; 24/200; 24/308

[58] Field of Search ..... 224/192, 198, 206, 209, 224/259, 260, 911; 2/326, 327, 328, 329, 333, 323, 336; 24/198, 200, 308, 312, 313

[56] References Cited

U.S. PATENT DOCUMENTS

| | | | |
|---|---|---|---|
| D. 185,583 | 6/1959 | Stella | 224/911 |
| 173,513 | 2/1876 | Sterling | 2/327 |
| 244,776 | 7/1881 | Wales | 24/198 |
| 726,842 | 5/1903 | Bauer | 24/312 |
| 1,868,828 | 7/1932 | Haines | 24/312 |
| 2,233,397 | 3/1941 | Bloom | 119/96 |
| 2,396,118 | 5/1946 | Ohlemeyer | 224/911 |
| 4,212,418 | 7/1980 | Bianchi | 224/206 |
| 4,346,827 | 8/1982 | Bianchi et al. | 224/209 |
| 4,901,373 | 2/1990 | Broersma | 24/200 |

FOREIGN PATENT DOCUMENTS

| | | | |
|---|---|---|---|
| 106478 | 2/1939 | Australia | 2/333 |
| 787550 | 9/1935 | France | 2/327 |
| 551156 | 5/1932 | Germany | 2/327 |
| 283084 | 2/1931 | Italy | 2/328 |

*Primary Examiner*—Linda J. Sholl

*Attorney, Agent, or Firm*—Brown, Martin, Haller & McClain

[57] ABSTRACT

A connecting device for connecting straps in a shoulder harness for carrying a handgun is a flat plate with a slot for forming a flat fold in a first strap, and first and second pairs of slots arranged in a triangular pattern with the fold forming slot for retaining portions of the strap on opposite sides of the fold flat against the plate. The plate has an additional opening for connection to another strap, for example to fasten the folded strap to a wearer's belt below the arm to avoid chafing, or to pivotally secure the plate to a second, identical plate to form a pivotal connection between opposite arm straps. In the first case, the plate has an additional slot parallel to the fold forming slot for receiving an additional strap threaded through the additional slot. Preferably, the plate also has an opening for optionally receiving a pivotal connector extending through a corresponding opening in another identical plate to pivotally secure the plates together.

12 Claims, 2 Drawing Sheets

SHOULDER HARNESS WITH CONNECTOR PIECE

CROSS-REFERENCE TO RELATED APPLICATIONS

This application is a continuation-in-part of my application Ser. No. 07/639,792 filed Jan. 10, 1991 and entitled "Connector Piece for Shoulder Harness".

BACKGROUND OF THE INVENTION

The present invention relates generally to shoulder harnesses for supporting gun holsters in an underarm position, and is particularly concerned with a connector piece for use in connecting straps in such harnesses.

The underarm shoulder holster for handguns dates back into the 19th century and is known to have been used in the Old West by gunfighters. One early U.S. Pat. No. 609,317 of Zimmerman, describes a harness for supporting an underarm holster which has one loop for suspending the holster under one arm of the wearer opposite the shooting hand, and another strap passing around the wearer's back to encircle the wearer's opposite arm at the shoulder level. With this design, there are no straps passing across the wearer's chest which could otherwise reveal that a handgun is being worn concealed by the wearer. This type of harness is generally referred to as the "open chest" harness.

The open chest harness is the current standard for underarm shoulder holsters, and is used extensively for handguns of all types, and by such handgun users as civilians, law enforcement personnel, military personnel, and other professionals who need to carry a concealed weapon. Its advantages are that it can make the holster concealable under a jacket, for example, and that it is relatively easy to put on and take off.

However, the current known types of open chest harness do have some disadvantages. One nagging problem has been that of the discomfort that it causes the wearer. The strap of leather, fabric, or elastic that passes around the arm opposite the holster (referred to as the "off arm") commonly chafes under the armpit. The heavier the combined weight of the handgun and holster is, and the more slippery the shoulder harness, the more the strap passing around the off-arm digs into the armpit. One technique which has been used in the past to avoid this problem is to fasten the strap to the wearer's belt below the arm, pulling the loop away from the armpit and avoiding chafing. However, the fastener for pulling the strap down can be relatively bulky, and bunching of the strap can also occur as it is pulled down.

Another problem in open chest harnesses is that, in any harness having a strap passing across the wearer's shoulders at the top of the spine and the base of the neck, pressure is applied by the strap at that point, which can cause nagging, continuous discomfort, thereby creating tension and fatigue in the wearer.

This problem has been overcome to some extent by crossing over the straps behind the wearer's back in an X shape. In U.S. Pat. No. 981,292 of Lewis, for example, instead of a single strap passing across the back at the top of the shoulders to connect the loops passing around each arm, the harness comprises a pair of straps which cross over at the wearer's back and pass over both shoulders with the ends being secured together beneath the wearer's arms. In order to reduce chafing under the wearer's arms, suitable fasteners secure the harness to the wearer's belt below the arms, to pull the straps downwardly away from the underarm region.

Many harnesses have been devised with X-crossed straps at the wearer's back, in some of which the straps are simply crossed over while remaining separate, and in others of which the straps are secured together at the cross over point. One example of the latter type of harness is U.S. Pat. No. 4,750,652 of Grant, in which first and second pairs of straps are secured together via a back connector piece.

Another disadvantage of these and other conventional shoulder harnesses is that they are either non-adjustable or not easily adjustable to wearers of different sizes. There is a very wide range of potential wearer sizes for shoulder harnesses, with research on police officers, who are among the most extensive users of shoulder harnesses, showing that a range of prospective wearer sizes extends from 5'5" to 6'4" in height and from 133 pounds to 261 pounds in weight, as well as chest sizes from 34" to 55". In order to accommodate this potential size range, while primarily designing shoulder holster harnesses to fit average size wearers, holster manufacturers have either provided harnesses in a range of different sizes, or provided harnesses which are adjustable via snap fasteners or the like. Typically, the latter variety are complicated and difficult to adjust, and often require either a helper to adjust the harness while it is worn, or removing and re-donning the harness repeatedly while a series of adjustments are made in attempting to reach an ideal fit. The adjustment mechanisms are also often bulky and thus reduce the chances of effectively concealing the harness.

Yet another problem with current shoulder harnesses is that they are typically designed to fit only right-handed or only left-handed wearers, requiring the manufacturer to make a range of different size harnesses for both right- and left-handed wearers. Some universal harnesses have been devised which can be adjusted for wear by a left- or right-handed wearer, with varying degrees of success. However, up to now no harness has been devised which can universally fit the entire range of users, both right- and left-handed, by a quick and easy adjustment.

SUMMARY OF THE INVENTION

It is an object of the present invention to provide a new and improved connector piece for a shoulder harness which overcomes or reduces the problems in existing shoulder harnesses.

According to the present invention, an adjustable shoulder harness for carrying a weapon is provided, which comprises right and left hand shoulder straps for encircling the respective right and left shoulders of a wearer, and a connector piece is provided for re-directing a strap of the shoulder harness at an angle to form a flat fold in the strap and for optionally connecting the re-directed strap to a second strap, for example to fasten the re-directed strap to a wearer's belt below the arm to avoid underarm chafing, or to fasten one strap of the harness to the other strap extending around an opposite arm of the wearer. The connector piece may also be connected to a holster below the wearer's arm.

In a preferred embodiment of the invention, the connector piece basically comprises a flat plate having first and second pairs of parallel slots at an angle to one another, and a third slot spaced from the first and second pairs of slots, the slots being arranged to form a generally triangular pattern. A strap forming part of a shoulder harness is passed through the slots in order to form a flat fold in the belt at a desired position, for example below the wearer's arm. The strap is passed upwardly through one of the slots of the first pair, then downwardly through the second slot of that pair, before being passed upwardly through the third slot and then folded back towards the second pair of slots at the appropriate angle. The strap then passes downwardly through the innermost slot of the second pair, then back upwardly through the outermost slot. The two pairs of slots act as a retention device for frictionally resisting free sliding or slipping of the strap through the connector plate slots, while permitting adjustment of the connector plate as necessary along the length of the strap by urging the strap through the successive slots.

Preferably, the plate has an additional, outer slot parallel to the third slot for receiving a fastener such as an additional short strap for attaching the connector plate to the belt at the waist of a wearer, ensuring that the connector plate does not ride up and cause discomfort in the underarm region. Additionally, the plate may have an opening adjacent the third slot for pivotally securing the plate to a second, identical plate for forming a pivotal connection between two straps which are redirected at the plates to form oppositely-directed flat folds in the respective straps, or for securing the plate to a holster.

The connector plate re-directs a strap of a handgun shoulder harness at a desired angle while retaining the strap in a flat condition and resisting buckling of the strap as it is pulled during movement of the wearer. The device allows the strap to be retained away from the wearer's armpit while retaining a flattened fold in the strap for comfort against the wearer's body. The plate can be used by either right- or left-handed wearers, simply by changing the direction in which the harness strap is passed through the device, since the device is symmetrical about its center line. Additionally, two connector plates may be pivoted together directly or via an additional plate or connector to form a flat, pivotal connection between two straps passing around the opposite arms of a wearer, for example.

The same basic flat connector plate can be used either to form a flat fold in a shoulder harness strap below a wearer's arm to reduce underarm chafing, or can be pivoted to a second, identical connector plate to form a flat, pivotal connection between two separate right and left hand shoulder straps at a region behind the wearer's back. The connector plate is flat and compact so that it can be easily concealed beneath the wearer's clothing. The plate may have additional openings to allow holsters and/or other accessories to be connected to the device using simple fasteners such as screws or rivets.

When a pair of plates are pivoted together to form a flat pivotal connection, the harness halves function independent of one another and can be mixed and matched, unlike crossed strap systems. The pivotal connector plates can be moved along the length of the straps so as to move the pivotal connection point vertically along the spine of the wearer, allowing the harness to be fitted to different sized individuals and to relieve pressure at the top of the wearer's spine. The pivotal connection permits the harness to move with the wearer, reducing pressure and resultant fatigue.

The simple connector plate of this invention can therefore provide a flat fold in a shoulder harness strap below the wearer's arm which can be pulled downwardly away from the armpit to reduce discomfort. The plate can also be used to form flat folds in separate, shoulder encircling straps and pivot the straps together at a region behind the wearer's back, simply by pivotally connecting two identical connector plates. This provides a simple, flat strap connecting system which avoids bunching up of the straps as the wearer moves and which is easily concealable beneath clothing.

BRIEF DESCRIPTION OF THE DRAWINGS

The present invention will be better understood from the following detailed description of a preferred embodiment of the invention, taken in conjunction with the accompanying drawings, in which like reference numerals refer to like parts, and in which.

DESCRIPTION OF THE PREFERRED EMBODIMENT

Figure 1:
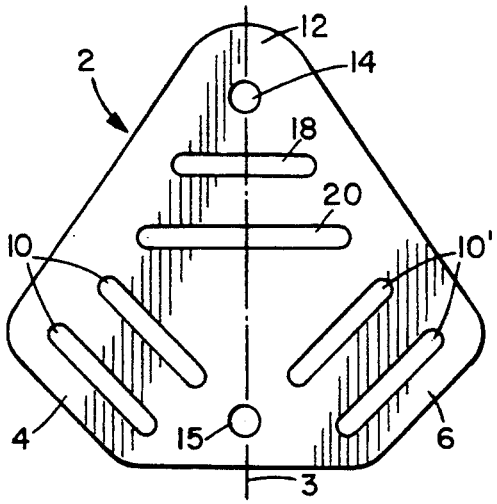
FIG. 1 is a top plan view of a connector piece according to a preferred embodiment of the present invention.
Figure 4:
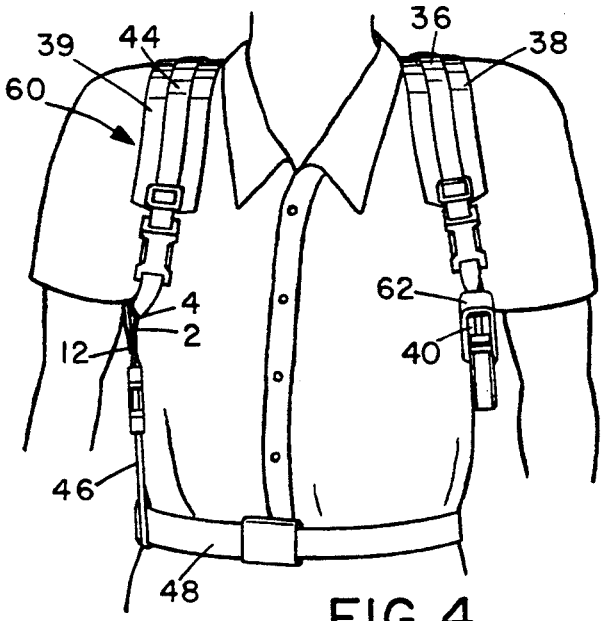
FIG. 4 is a front view of a shoulder harness illustrating use of a connector piece as in FIG. 1 to adjust a shoulder strap beneath a wearer's arm.
Figure 3:
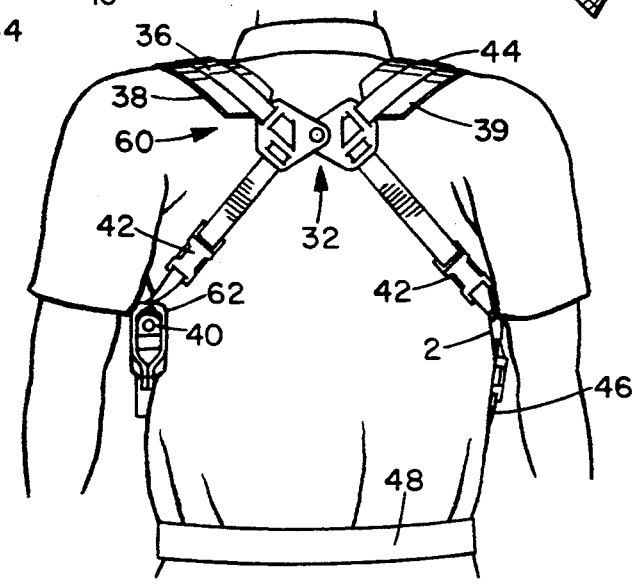
FIG. 3 is a rear view illustrating use of the connector pieces as in FIG. 2 to form a pivotal connection in a shoulder harness.

FIG. 1 illustrates a connector piece 2 for use in a shoulder holster harness 60 as illustrated in FIGS. 3 and 4. The connector piece 2 basically comprises a flat plate which is of five-sided shape which is generally triangular and has an apex 12 and two truncated corners 4 and 6. The plate is symmetrical along longitudinal axis 3. A first pair of parallel slots 10 is provided adjacent base corner 4, and a second pair of parallel slots 10' is provided adjacent the opposite base corner 6, at an angle of approximately 90 degrees to the first pair of slots 10. The angle between the respective pairs of slots may be adjusted according to the desired belt fold angle. A third pair of parallel slots 18, 20 are provided adjacent apex corner 12 and extending transversely across longitudinal axis 3 so as to form a generally triangular pattern with the first and second pair of slots. Although the plate is of five sided generally triangular shape in the preferred embodiment illustrated, it may be of alternative shapes such as round, square, or other shapes, as long as the slots are arranged in a triangular pattern relative to one another. In the preferred embodiment illustrated, slot 20 is longer than the other slots, with the other slots being of length substantially equal to the width of a strap to be passed through the slots, as will be explained in more detail below.

In addition to the three pairs of slots, a pair of circular openings 14 and 15 are provided along the axis of symmetry 3, one opening 14 being positioned adjacent apex corner 12 and the other opening 15 being positioned adjacent the base of the plate. The connector plate may be formed of any sufficiently rigid material such as plastic, metal, leather, or like materials.

Figure 2:
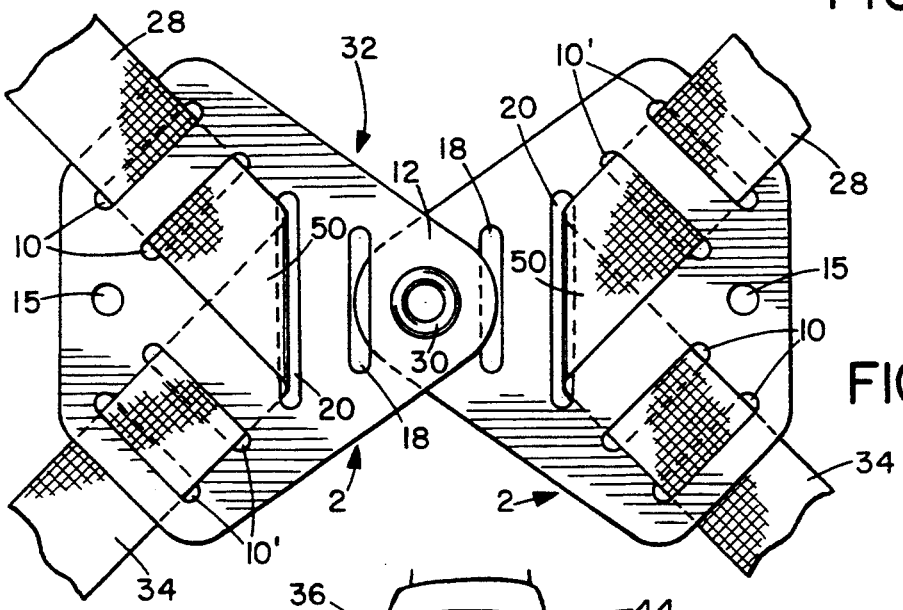
FIG. 2 is a top plan view of two of the connector pieces pivoted together to form a pivotal connection in a shoulder harness according to another aspect of the invention.

The connector plate may be used alone as in FIG. 1, or may be pivoted to another, identical connector plate as in FIG. 2 by overlapping the apex corners 12 of the respective plates so that openings 14 are aligned, and passing a pivot pin, grommet or rivet 30 through the openings. This allows the plates to be pivoted together in a substantially flat condition. The connector plate, or each connector plate in the case of the pivoted connection of FIG. 2, is designed to form a flat, adjustable fold 50 in a strap 28 as generally illustrated on the left or right hand side of FIG. 2.

In order to form flat fold 50, strap 28 is passed first downwardly then upwardly through the first pair of slots 10, which are of sufficient width to permit the thickness of the strap to pass freely through the slots. The strap is then passed through slot 20, and doubled back on itself to form flat fold 50 before being passed first upwardly and then downwardly through the second pair of slots 10'. The two pairs of slots 10 and 10' act as retainers to restrain the strap against free slipping through the device on normal wear, but allow the position of the plate on the strap to be adjusted by actively pulling it along the strap. The slot 20 is longer than slots 10 and 10' so that the strap can move freely through it if a length of strap is released by pulling through either slots 10 or 10'. The primary function of slot 20 is to provide a folding point for the strap 28 to be doubled back or folded over at an angle from its entry direction, as controlled by the angle between entry slots 10 and exit slots 10'. In the illustrated embodiment, the fold angle between incoming strap portion 28 and outgoing strap portion 34 is 90 degrees, although connector plates having different fold angles may alternatively be provided.

The connector plate is particularly intended for use with straps of material such as nylon webbing which is sufficiently pliable to allow it to be fed through the slots and adjusted as necessary. It may be used with leather straps, although straps of this material may be more difficult to feed through the slots.

FIGS. 3 and 4 illustrate use of the connector plate 2 in two different ways with an underarm shoulder harness 60. In the drawings, a harness for a right-handed wearer is illustrated, in which a first strap 36 loops over the left shoulder of a wearer and carries a holster 62 for a handgun 40 beneath the wearer's left arm, and a second strap 44, known as the off-arm strap, loops over the right shoulder of the wearer to support the weight of the handgun. Standard sliding buckles 42 on each strap 36, 44 allow the straps to be lengthened or shortened as necessary to fit the wearer. Widened strap portions 38, 39 are provided at the shoulder region of each strap for added comfort. It will be understood that the connector plate could be used in an equivalent manner in a harness for a left-handed wearer, by adjusting the direction of insertion of the strap through the plate as appropriate.

As illustrated in FIG. 3, the first and second straps 36, 44 are connected together behind the wearer's back by a pivotal connector 32 comprising a pair of the connector plates 2 pivoted together in a flat condition as illustrated in FIG. 2. Each strap 36, 44 is passed through the slots 10, 20 and 10' in the respective connector plate 2 to form flat, oppositely directed folds 50 in the respective straps.

The pivoting connector 32 simulates crossed straps in a shoulder harness but without their limitations. The pivotal connection between the plates 2 permits the harness to move easily with the wearer through a wide pivoting range, unlike simple crossed straps which cannot pivot. The connector 32 can be located at the center of the back between the wearer's shoulder blades and away from the top of the spine and base of the neck, so that no pressure is applied at this sensitive point which could otherwise cause substantial discomfort. Additionally, the connector 32 can be adjusted up or down along the spine simply by sliding the two respective plates 2 along the two shoulder straps 36, 44, allowing the same basic shoulder harness to be fitted on wearers having a large range of body sizes. When the pivoting connector 32 is adjusted upwards along the wearer's spine, the shoulder straps are moved closer together to fit a smaller build wearer. Similarly, if the connector is adjusted downwards, the shoulder harness straps are moved further apart to fit larger wearers, with the wide pivoting range of the connector further accommodating such adjustments, allowing the harness to be fitted comfortably at the center of the back between the shoulder blades and to conform to persons of varying body characteristics.

Since the pivotal connector 32 is substantially flat and holds the connected straps in a flat-folded condition, it will not cause any discomfort due to straps bunching up, for example. Additionally, it will not cause any undue bulging in clothing worn over the harness. Another advantage of this device is that the two harness halves function independently of one another, and as such can be mixed and matched. Also, the harness can be converted from a right-handed to a left-handed harness simply by reversing the direction of strap insertion into the pivoting pair of connector plates, allowing the off arm strap 44 to be worn over the left arm rather than the right arm as in FIG. 4, and the holster carrying strap 36 to be worn over the right arm. Thus, the same basic harness can be easily adjusted for both right- and left-handed wearers having a large range of different body sizes and types.

FIG. 4 of the drawings illustrates use of a single connector plate 2 to connect the underarm portion of an off-arm strap 44 of a shoulder harness to the wearer's belt. Connector plate 2 may be used in the manner illustrated in FIG. 4 on the off-arm strap of any shoulder harness, either alone or in conjunction with the pivotal connector 32 as in FIG. 3. The off-arm strap 44 of a shoulder harness would normally tend to be pulled up into the wearer's armpit by the weight of the handgun pulling down on the opposite arm strap. Instead, in the arrangement of FIG. 4, the strap extends through the slots 10, 20 and 10' of connector plate 2 to form a flat fold. The plate 2 in turn is tied down to the wearer's belt 48 via connecting strap 46. Connecting strap 46 extends through the extra slot 18 parallel to the strap 20 which forms the flat fold in the shoulder strap, and can then be suitably secured to the wearer's belt via a buckle or other fastener. Although in the illustrated embodiment connector plate 2 is used under the right arm of the user, which will be the off arm of a right-handed user, it will be understood that the plate may be used in a similar manner under the left arm in the case of a left-handed user.

Figure 7:
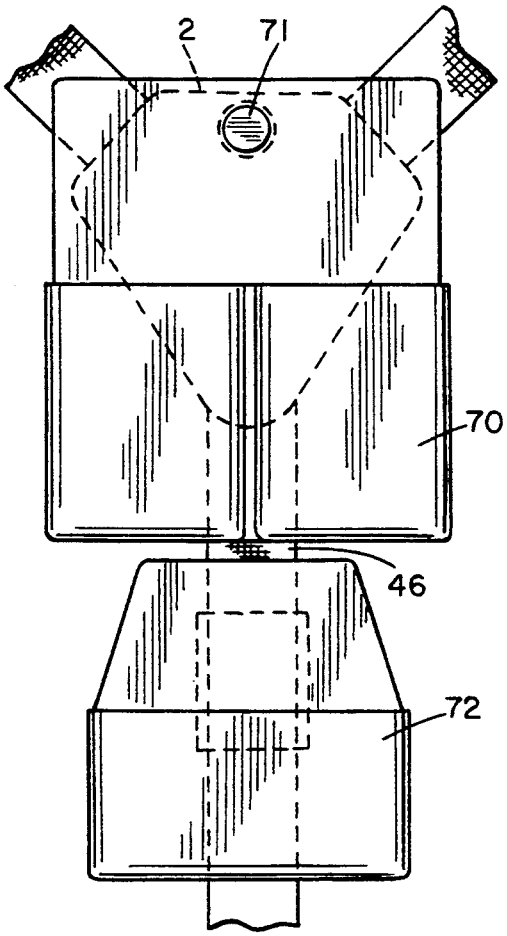
FIG. 7 is a side elevation view showing accessory pouches attached to a connector piece.

The connector plate and/or strap 46 may be used to hold standard accessory pouches of the type which are commercially available and designed to be mounted on a belt, as illustrated in FIG. 7. These pouches can be used to carry spare pistol magazines, revolver ammunition, handcuffs, and so on. Such accessory pouches may be attached directly to openings 14 or 15 in the connector plate itself via simple fasteners such as screws or rivets. FIG. 7 illustrates an ammunition pouch 70 attached via screw fastener 71 to the opening 15 in a connector plate 2 under the off-arm of a wearer. An additional pouch 72 is secured to the tie-down snap 46. This enables accessories to be concealed beneath the off arm. Additional openings may be provided in the plate for attaching accessories, if desired.

Figure 5:
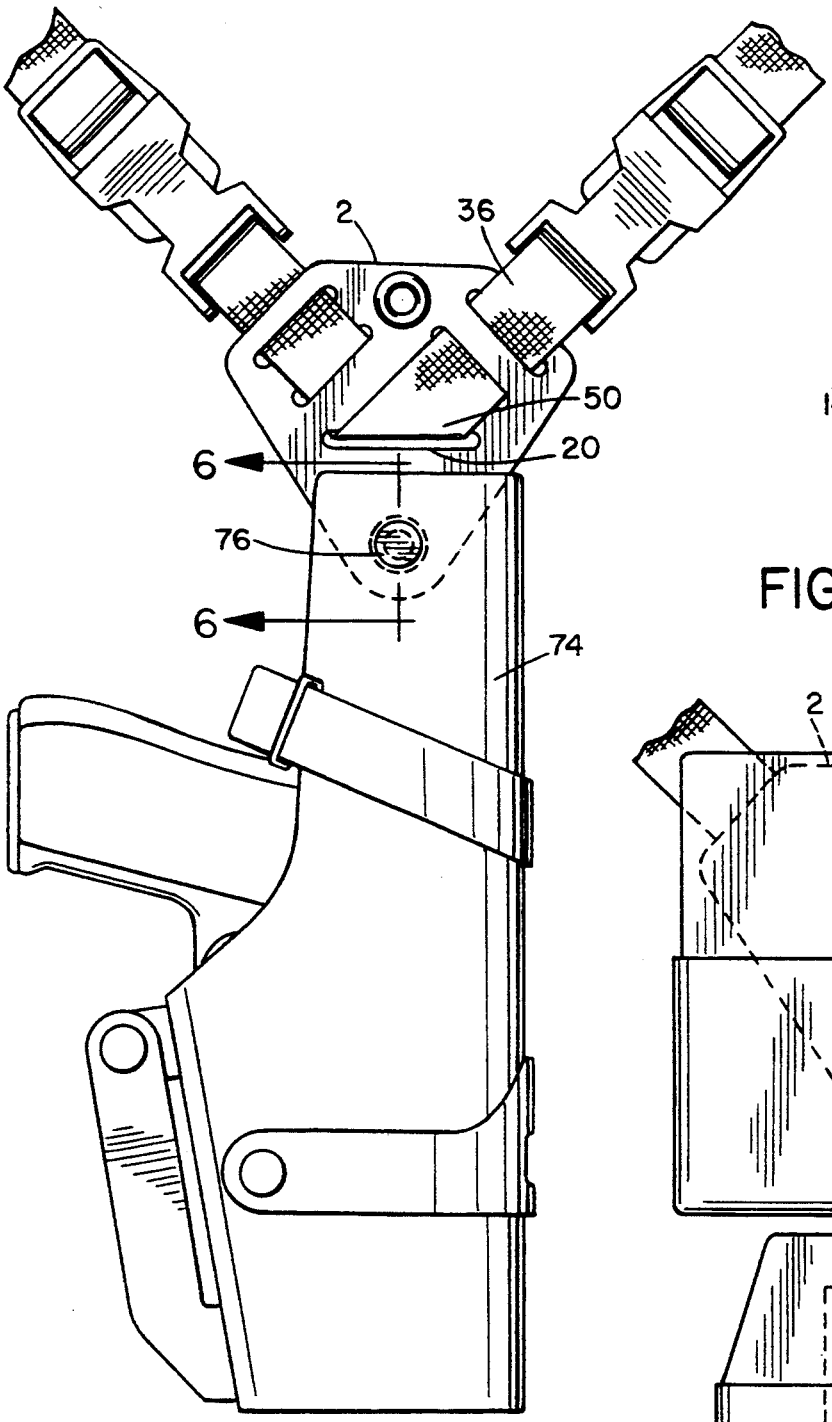
FIG. 5 is a side-elevation view showing a typical handgun holster suspended from a connector piece by a pivotal connection.
Figure 6:
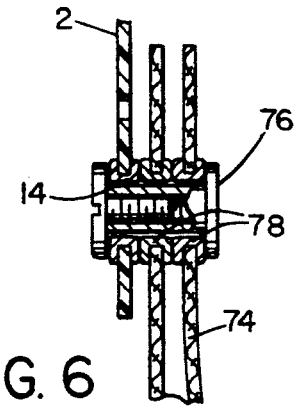
FIG. 6 is an enlarged sectional view taken on line 6—6 of FIG. 5.

In addition to the connector plate below the off-arm, a connector plate 2 may also be used to re-direct the strap 36 beneath the wearer's other arm, as illustrated in FIG. 5. Plate 2 forms a flat fold 50 in strap 36 beneath the wearer's arm, and can additionally be used for pivotally suspending a holster 74 from the strap. As illustrated in FIGS. 5 and 6, the holster is pivotally connected to the opening 14 in plate 2 via pivot pin 76 extending through opening 14 and aligned openings 78 in the top of the holster body. This arrangement allows the holster to move with the wearer's body, making it more comfortable and concealable.

Thus, single connector plates 2 may be used under one or both arms of a shoulder harness, as illustrated in FIGS. 4 and 5. Additionally, pivotally connected plates as illustrated in FIG. 2 may be used behind the wearer's back as in FIG. 3 to connect the right and left arm straps.

The connector plate of this invention is a versatile, easy-to-use, and compact accessory for any shoulder harness. It can be used to redirect an off-arm strap under the wearer's arm to form a flat fold which is held flat against the wearer, reducing the tendency of the strap to bunch up with arm movement. The connector plate and flat-folded strap can then easily be secured to the wearer's belt, pulling the strap away from the armpit while holding it flat. The connector plate can also be used to redirect a strap beneath the wearer's other arm to form a flat fold, and to pivotally connect the redirected strap to a holster.

The connector plate can also be pivoted to a second, identical plate to form a flat, easily-concealed pivotal connection between the two halves of a shoulder harness. The connection has a wide pivoting range, and can be adjusted up and down along the respective straps to fit different size individuals with optimum comfort. This allows the two harness halves to function independently, unlike cross-strap systems, and is much more comfortable for the wearer.

Although a preferred embodiment of the present invention has been described above by way of example only, it will be understood by those skilled in the field that modifications may be made to the disclosed embodiment without departing from the scope of the invention, which is defined by the appended claims.

I claim:

1. A shoulder harness for carrying a weapon, comprising:

right and left hand shoulder straps for encircling the right and left shoulders of a wearer, respectively;

a first flat plate having a fold forming slot threadably receiving one of said straps to form a fold between adjacent portions of the strap at a location beneath one of the arms of a wearer;

a first retainer on the plate for releasably retaining one portion of the strap on one side of the fold flat against the plate;

a second retainer on the plate for releasably retaining a portion of the strap on the opposite side of the fold flat against the plate;

the first and second retainers being at a predetermined angle to one another to form a flattened fold in the strap with adjacent strap portions on opposite sides of the fold at said predetermined angle to one another;

first connecting means parallel to said fold forming slot for connecting said plate to another strap;

a tie down strap secured to said first connecting means for securing said plate to a wearer's belt:

said plate having a center axis of symmetry, said first connecting means lying on said center axis, said fold forming slot extending transversely across said center axis, and said first and second retainers being arranged symmetrically on opposite sides of said center axis;

a second flat plate identical to said first flat plate and threadably receiving the other of said straps at a location beneath the other arm of a wearer to form a flattened fold in the strap;

each plate having second connecting means adjacent said first connecting means for selectively connecting the plate to a holster;

a holster connected to the second connecting means of said second flat plate;

said first and second connecting means lying on said axis of symmetry between said fold forming slot and the edge of said plate; and a pivotal connector connecting the right hand shoulder strap to the left hand shoulder strap at a location behind the wearer's back, the pivotal connector comprising a pair of flat connector plates identical to said first and second flat plates and a pivot connection between the plates for pivotally securing said plates together in a flat orientation, each of said shoulder straps extending through the fold forming slot of a respective one of said pair of pivoted plates to form a substantially flat fold in said strap, said retainers of said one plate frictionally resisting sliding movement of said strap through said slot.

2. The harness as claimed in claim 1, wherein each plate is of five sided, generally triangular shape having an apex and two truncated corners, said first and second pairs of slots each being arranged adjacent and parallel to a respective one of said truncated corners.

3. The harness as claimed in claim 1, wherein said second connecting means comprises pivot means for pivotally suspending a holster from the plate.

4. The device as claimed in claim 1, wherein said first connecting means comprises an additional slot parallel to said fold forming slot and spaced outwardly from said fold forming slot on said central axis.

5. The device as claimed in claim 1, wherein said plate has at least one additional opening lying on said center axis for securing accessories to said plate.

6. The harness as claimed in claim 1, wherein said first and second retainers comprise first and second pairs of parallel retaining slots, said retaining slots and said fold forming slot being arranged in a triangular pattern on said plate.

7. The harness as claimed in claim 6, wherein each plate has a central axis of symmetry and said slots are arranged symmetrically about said central axis.

8. Shoulder harness for carrying a weapon, comprising:

right and left hand shoulder straps for encircling the respective right and left shoulder of a wearer;

a pivotal connector for connecting the right hand shoulder strap to the left hand shoulder strap at a location behind the wearer's back, the pivotal connector comprising a pair of identical flat connector plates and a pivot connection between the plates for pivotally securing said plates together in a flat orientation, each connector plate having at least one fold forming slot for threadably receiving one of said shoulder straps and forming a substantially flat fold in said strap with portions adjacent said fold extending at a predetermined angle to one another, a first retainer for releasably retaining one portion of said one strap on one side of the fold flat against the plate, and a second retainer for releasably retaining a portion of said one strap on the opposite side of the fold flat against the plate, the retainers comprising means for frictionally resisting sliding movement of said strap through said slot;

a third flat connector plate identical to said first pair of plates, the third connector plate threadably receiving a portion of one of said straps at a location beneath one of the arms of a wearer to form a flattened fold in the strap;

each plate having connecting means adjacent said fold forming slot for selectively connecting the plate to a holster; and a holster connected to the connecting means of said third connector plate.

9. The harness as claimed in claim 8, wherein each flat plate has at least two additional slots comprising said first and second retainers, each slot being positioned for threadably receiving a respective portion of said strap on opposite sides of said fold.

10. The harness as claimed in claim 9, wherein said plate has a first pair of slots for threadably receiving a portion of said strap on one side of said fold, and a second pair of slots at an angle relative to said first pair for threadably receiving a portion of said strap on the other side of said fold.

11. The harness as claimed in claim 8, wherein each plate has an opening adjacent a position on its peripheral edge, said peripheral edge positions on said plates being overlapped with said openings in alignment, and said pivot connection extends through said aligned openings to pivotally secure said plates together.

12. The harness as claimed in claim 8, wherein a fourth connector plate is located beneath the off-arm of a wearer, the harness including a tie down strap secured to the fourth plate for securing the fourth plate to a wearer's belt.

* * * * *